United States Patent [19]

Grodin et al.

[11] 4,365,375

[45] Dec. 28, 1982

[54] VACUUM NOZZLE FOR POOL CLEANING

[76] Inventors: Jack Grodin; Bessie Grodin, both of 1332 E. Oakey Blvd., Las Vegas, Nev. 89104

[21] Appl. No.: 201,989

[22] Filed: Oct. 29, 1980

[51] Int. Cl.[3] ..... E04H 3/20

[52] U.S. Cl. ..... 15/1.7; 15/398; 15/415 R

[58] Field of Search ..... 15/1.7, 393, 398, 399, 15/400, 401, 402, 415 R

[56] References Cited

U.S. PATENT DOCUMENTS

| | | | |
|---|---|---|---|
| 2,977,613 | 4/1961 | Mikulas | 15/1.7 |
| 3,039,122 | 6/1962 | Birdsall | 15/1.7 |
| 3,371,371 | 3/1968 | Steccone | 15/402 |
| 3,795,027 | 3/1974 | Lindberg | 15/398 |

FOREIGN PATENT DOCUMENTS

| | | | |
|---|---|---|---|
| 763340 | 12/1956 | United Kingdom | 15/400 |

*Primary Examiner*—Edward L. Roberts
*Attorney, Agent, or Firm*—Darby & Darby

[57] ABSTRACT

A vacuum nozzle is described which is particularly adapted for use in combination with a conventional swimming pool brush for removing leaves and debris from the floor of a pool having a flexible liner. Mounting means is provided which positions the mouth of the nozzle sufficiently forward of the bristles of the brush so that leaves or debris which may become clogged in the bristles do not clog or constrict the mouth. The bristles serve to space the nozzle mouth from the pool floor to avoid the possibility of the liner being sucked into the mouth.

6 Claims, 2 Drawing Figures

VACUUM NOZZLE FOR POOL CLEANING

BACKGROUND OF THE INVENTION

This application relates to vacuum nozzles and more particularly for vacuum nozzles for cleaning underwater surfaces such as swimming pool bottoms.

A number of vacuum nozzles adapted for cleaning underwater surfaces such as swimming pool bottoms are known. One of the more demanding tasks which these nozzles are meant to perform is that of removing leaves and other debris from the bottom of such a pool. As will be discussed below, this task is a particularly difficult one when the pool to be cleaned is one which incorporates a flexible liner such as one of vinyl.

One presently known type of pool vacuum nozzle, which is adapted for picking up leaves, has a nozzle opening or mouth which, during use, is maintained in a position which is quite close to the floor of the pool. An example of such a nozzle is the one described in U.S. Pat. No. 1,056,779 of Davidson. Such a nozzle is not, however, suitable for use in cleaning a vinyl liner pool since the close proximity of its nozzle opening to the floor of the pool could tend to result in the vinyl liner of the pool being sucked into the nozzle opening thereby inhibiting free movement of the nozzle.

Another type of currently utilized pool vacuum nozzle combines the function of a brush with that of a vacuum nozzle. Examples of this type of nozzle are set forth in U.S. Pat. No. 3,039,122 of Birdsall and U.S. Pat. No. 3,795,027 of Lindberg, Jr. This type of nozzle may be used to clean vinyl-liner pools because the only portions of such a nozzle which make contact with the liner are the bristles of the brush. Consequently, suction sufficient to suck the liner into the nozzle opening is not created. This type of nozzle is not, however, as effective for removing leaves and debris from pools as is the previously discussed type of nozzle since the leaves and debris become lodged in the bristles of the brush. The amount of such debris lodged in the bristles eventually builds up until the opening of the nozzle becomes clogged or constricted.

SUMMARY OF THE INVENTION

The vacuum nozzle of the present invention avoids all of the above problems and provides an effective means for removing leaves and other debris from vinyl liner-type pools. The nozzle is adapted to be attached to a conventional pool brush in a manner such that an elongated nozzle opening is positioned parallel to and in front of the brush, and is directed generally downward toward the surface to be cleaned. The mounting arrangement also makes use of the bristles of the brush to maintain a sufficient clearance between the nozzle opening and the surface being cleaned so that a vinyl liner does not tend to be sucked into the opening. The relative positions of the brush and the nozzle opening further ensure that leaves or debris which may become lodged in bristles of the brush will not cause constriction or clogging of the nozzle opening.

It is, therefore, an object of the present invention to provide a vacuum nozzle which is adapted to be attached to a conventional pool brush and which, in cooperation with a conventional vacuum pump and pool filter, is particularly effective for removing leaves and debris from the bottom of a swimming pool.

It is a further object of the invention to provide a mounting arrangement for a swimming pool vacuum nozzle which prevents the flexible liner of the pool from being sucked into the opening of the nozzle.

It is a still further object of the invention to provide an arrangement by which the nozzle opening is made relatively immune from clogging or constriction by leaves or debris during usage.

Other objects and advantages of the present invention will become more apparent upon reference to the following specification and the annexed drawings in which:

FIG. 1 is a side view of the nozzle of the present invention attached to a conventional pool brush; and FIG. 2 is a sectional view taken along the line 2—2 of the nozzle of FIG. 1.

DESCRIPTION OF THE PREFERRED EMBODIMENT

Figure 1:
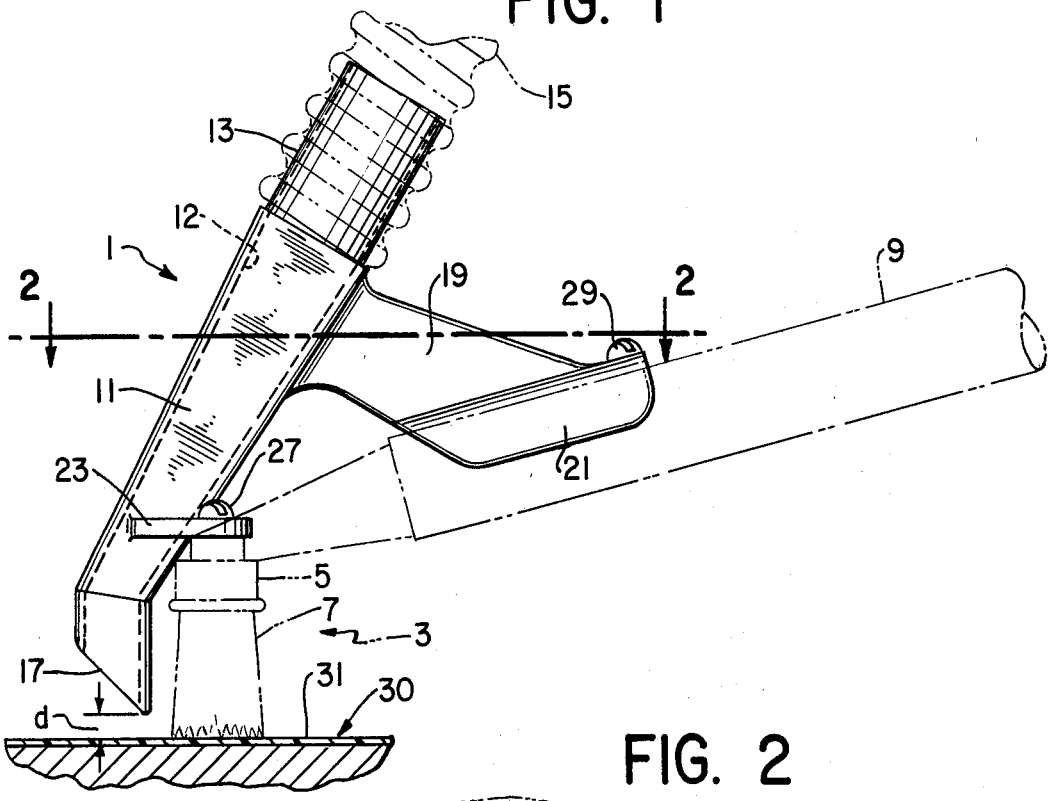

Referring to the drawings, there is shown a vacuum nozzle, denoted generally by the numeral 1, which is adapted to be attached to a conventional pool brush, denoted generally by the numeral 3.

The pool brush 3 includes a brush head 5 from which extend a plurality of bristles 7. A brush handle 9 extends from the brush head 5. This brush handle 9 may be formed integrally with the brush head 5 but more typically is adapted to be connected to the brush head 5 and may, for example be of the telescoping type.

The nozzle 1 may typically be formed of a plastic or rubber-type material. The nozzle 1 includes a housing 11 which is preferably formed integrally with a hose coupling 13. The hose coupling 13 is adapted to accept a hose 15 which connects the nozzle to a conventional pool vacuum pump and filtering apparatus (not shown). The housing 11 defines a channel space 12 communicating with coupling 13 and which opens into an elongated nozzle mouth or opening 17.

In order to remove leaves and debris from the floor of a pool effectively, the opening 17 is directed in a generally downward direction. Thus, the opening 17 may be in a plane which is parallel or nearly parallel to the surface 30 to be cleaned. I have found the nozzle to be particularly effective, however, when this plane makes an acute angle of about 45 degrees with the surface 30 upon which the leaves or debris are lying. Consequently in the illustrative embodiment of FIG. 1, the nozzle 1 is mounted on the brush 3 in a manner such that the nozzle mouth 17 is in a plane which makes an acute angle with a surface 30 when the brush bristles 7 are generally perpendicular to the surface 30. This mounting arrangement ensures that, when the brush is tilted forward, the edges of the housing 11 defining the opening 17 do not touch the surface 30. Where, as in FIG. 1, the surface 30 is the surface of a flexible pool liner 31 (such as the common vinyl lints), the danger of this liner 31 being sucked into the nozzle opening 17 is thereby minimized.

Figure 2:
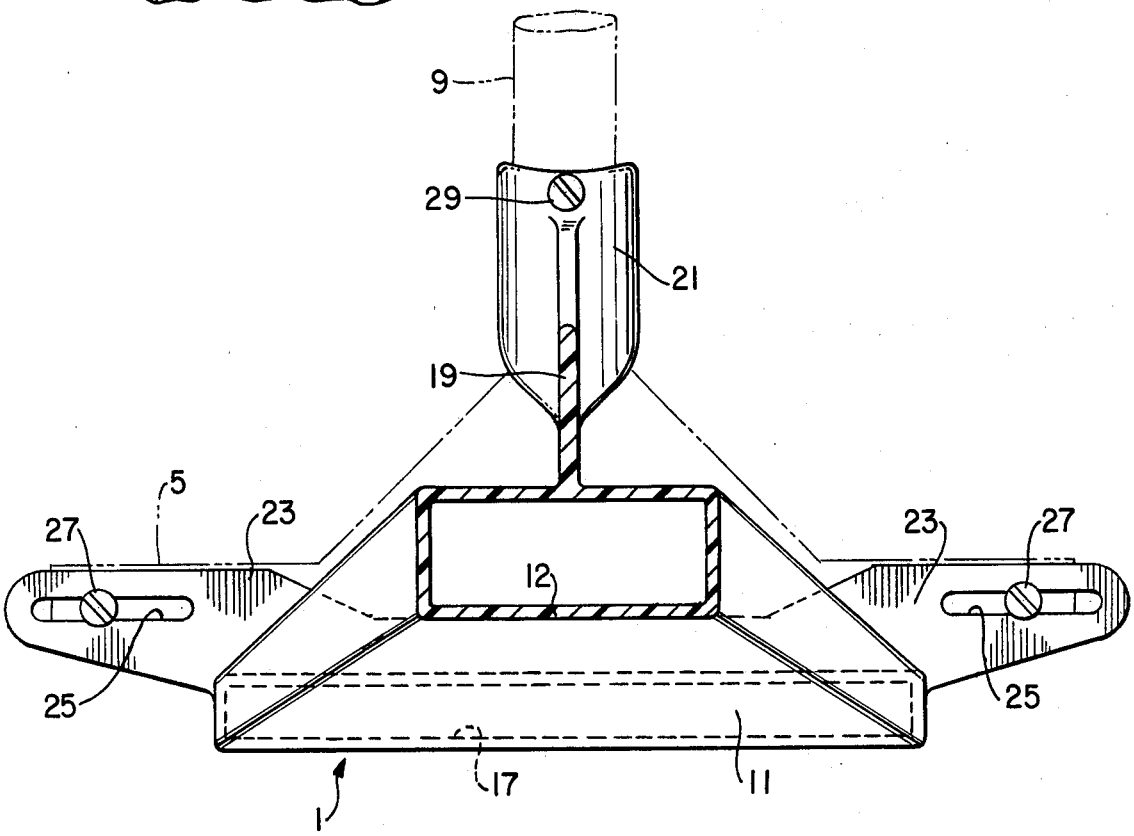

A number of means suitable for attaching the nozzle 1 to the brush 3 will be apparent to those skilled in the art. In the illustrative embodiment of FIGS. 1 and 2 a pair of flanges 23 extend from the housing 11 in a direction generally parallel to the longitudinal axis of the brush head 5. Each of the flanges 23 includes a slot 25 which is adapted to accept a respective screw 27 (e.g., a self-tapping screw) which may be employed to secure the brush head 5 to the flange 23.

Extending rearwardly from the housing 11 is an extension 19 having an end which forms a curved seat 21 which is adapted to conform to the shape of the brush handle 9. The seat 21 may be fastened to the handle 9 by suitable means, such as a screw 29.

It will be understood that the above description of a means for fastening the nozzle 1 to the brush head 5 and brush handle 9 is meant for the purpose of illustration only. Numerous alternative fastening means, such as clips, bands, adhesives or the like would be equally effective as long as the desired positional relationship between the opening 17 of the nozzle 1, the bristles 5 of the brush 3, and the pool surface 30, is maintained. This relationship is one in which the opening 17 is positioned forward of the bristles 3 of the brush, and is prevented by these bristles from coming closer to the pool surface than a distance indicated by the letter "d" of FIG. 1.

This distance "d" may be defined as that distance which is sufficiently small to allow leaves and debris to be effectively sucked into the opening 17, but which is great enough to prevent the vinyl liner 31 of the pool from also being sucked into the opening 17. The optimum value for the distance "d" will vary depending on the size and shape of the nozzle opening 17, the angle which the plane of the nozzle opening 17 makes with the pool surface 30, and the characteristics of the pump and filter utilized to provide suction to the nozzle. In one presently preferred embodiment, the nozzle opening 17 has dimensions of approximately 8 inches by $\frac{3}{8}$ of an inch and thus covers an area of approximately 5 square inches. When connected to a pump having an outlet pressure of 12 pounds per square inch, through a pool filter having a capacity of 72 gallons per minute, such a nozzle has been found to be particularly effective for removing debris when the distance "d" is selected to be approximately $\frac{1}{4}$ of an inch.

Other embodiments employing a corresponding relationship between the area of the opening 17, the distance "d" and the capacity of the pumping and filtering apparatus should be equally as effective. For example, a nozzle having a larger opening could be employed at the same distance "d" from the surface 30 as the previously described embodiment if a pumping and filtering apparatus of correspondingly greater capacity is utilized (e.g. if the area of the nozzle opening 17 is doubled the capacity of the pumping and filtering apparatus should also be doubled).

While only one embodiment of the present invention has been shown and described, it will be apparent to those persons skilled in the art that many changes and modifications may be made thereto without departing from the spirit and scope of the invention as defined in the appended claims.

What is claimed is:

1. A vacuum nozzle for removing leaves and debris from an underwater surface and adapted for use in combination with a swimming pool brush which has a plurality of downwardly directed bristles, said nozzle comprising:

a housing having a centrally disposed channel extending therethrough, a vacuum hose coupling formed with said housing and opening into said channel, and an elongated mouth, having a front edge and a rear edge, opening into said channel;

means for attaching said housing to said brush in a position in which the mouth is spaced forwardly from the bristles to prevent clogging or constriction of said mouth by leaves or debris lodged in said bristles and in which the front edge of said mouth is spaced a greater distance from said surface than said rear edge to prevent the front edge from contacting the underwater surface when the nozzle is tilted forwardly.

2. The nozzle of claim 1 adapted for use in a pool having a flexible liner wherein said attaching means is adapted to position said mouth a distance above the ends of said bristles to prevent the liner from being sucked into said mouth.

3. The nozzle of claim 2 wherein said attaching means further includes means for connecting said housing to a brush handle.

4. A device for cleaning underwater surfaces such as flexible liner-type pool bottoms, comprising:

a housing having a centrally disposed channel space extending therethrough;

a vacuum hose coupling opening into said channel;

an elongated mouth opening into said channel and forming a nozzle having a front edge and a rear edge, said front edge being spaced a greater distance from said surface than said rear edge to prevent the front edge from contacting the surface when the housing is tilted forwardly; and a plurality of downwardly directed brush bristles adjacent to and spaced from the rear edge of said mouth so that leaves or debris which may become lodged in said bristles do not clog or constrict said mouth.

5. The device of claim 4 wherein said bristles extend below said mouth and serve to space said nozzle from said surface to prevent said flexible liner from being sucked into said mouth.

6. The device of claim 1 or claim 4 wherein said mouth is in a plane forming an angle of approximately 45 degrees with the underwater surface when said bristles are substantially perpendicular to the surface.

* * * * *